US005826445A

United States Patent [19]

Okamoto

[11] Patent Number: 5,826,445

[45] Date of Patent: Oct. 27, 1998

[54] KNITTING METHOD ON A FLAT KNITTING MACHINE AND A KNIT FABRIC THUS PRODUCED

[75] Inventor: Kazuyoshi Okamoto, Nara, Japan

[73] Assignee: Shima Seiki Manufacturing Ltd., Wakayama, Japan

[21] Appl. No.: 796,557

[22] Filed: Feb. 7, 1997

[30] Foreign Application Priority Data

Feb. 9, 1996 [JP] Japan ..... 8-023514
Feb. 15, 1996 [JP] Japan ..... 8-027486

[51] Int. Cl.[6] ..... D04B 7/10

[52] U.S. Cl. ..... 66/70; 66/176

[58] Field of Search ..... 66/70, 169 R, 66/170, 171, 172 R, 175, 176, 69, 75.1, 169 A, 60 R, 68, 189

[56] References Cited

U.S. PATENT DOCUMENTS 3,640,097 2/1972 Betts et al. ..... 66/176
3,695,063 10/1972 Betts et al. ..... 66/176
3,702,068 11/1972 Betts et al. ..... 66/176
3,882,697 5/1975 Betts et al. ..... 66/176
4,197,724 4/1980 Robinson et al. ..... 66/176
5,202,070 4/1993 Schneider .
5,379,615 1/1995 Shima ..... 66/176
5,456,096 10/1995 Mitsumoto et al. ..... 66/69

OTHER PUBLICATIONS

Japanese Provisional Patent Hei 2–229248 (English Abstract).
Japanese Provisional Patent HEI 2–91254 (English Abstract).

*Primary Examiner*—Peter Nerbun
*Assistant Examiner*—Larry D. Worrell, Jr.
*Attorney, Agent, or Firm*—Nikaido, Marmelstein, Murray & Oram LLP

[57] ABSTRACT

In a joining portion of a body and a sleeve of a pullover, only a front body is knitted, stitches of a front part of sleeve are transferred to the front body for joining the front body and the sleeve, and stitches of a back part of sleeve are shifted to the front part. In the back body, knitting of a whole width of the back body and knitting only a side edge are executed, during these operations stitches at the side edge are shifted inward, and an outer most stitch of the front body is shifted to the side edge of the back body.

14 Claims, 13 Drawing Sheets

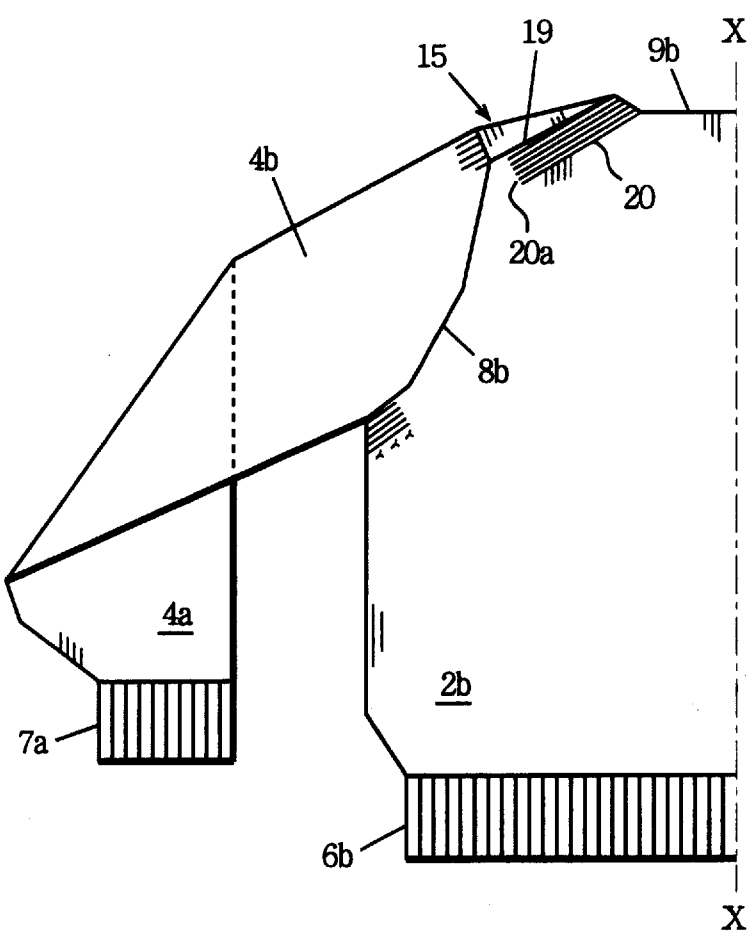
Fig. 2-B
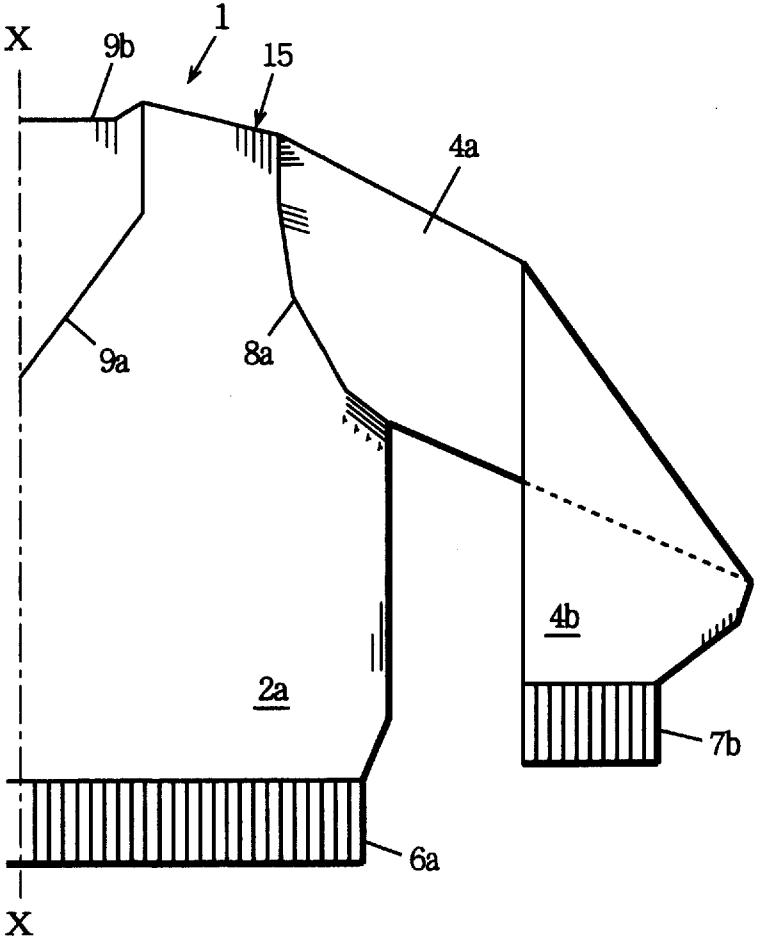
Fig. 2-A

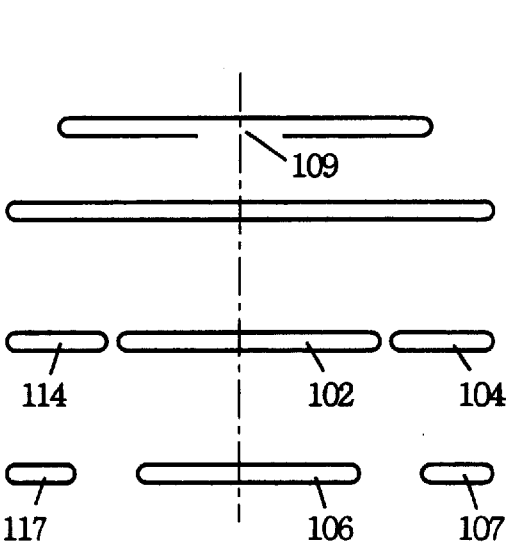
Fig. 10-B (Prior Art)
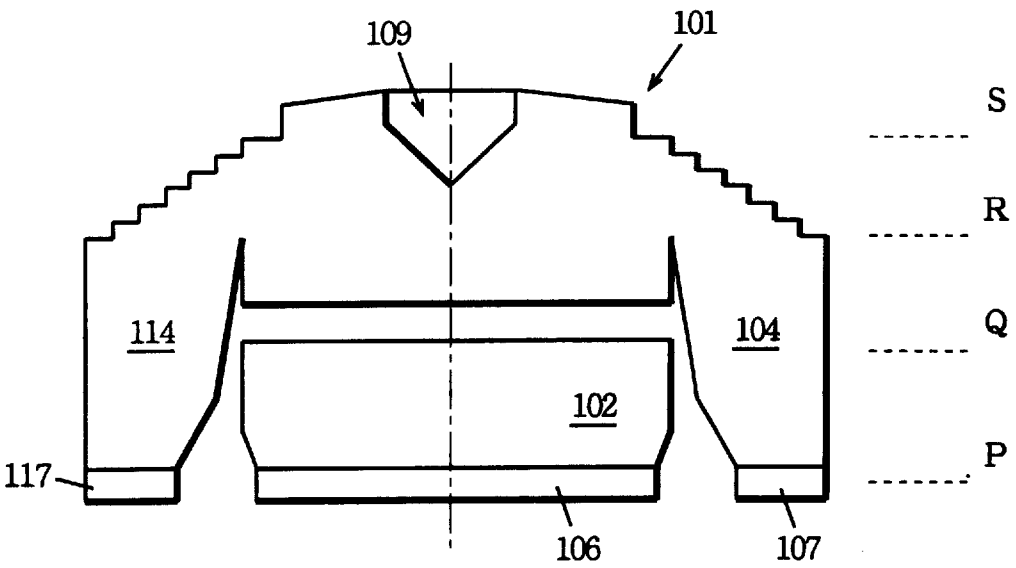
Fig. 10-A (Prior Art)

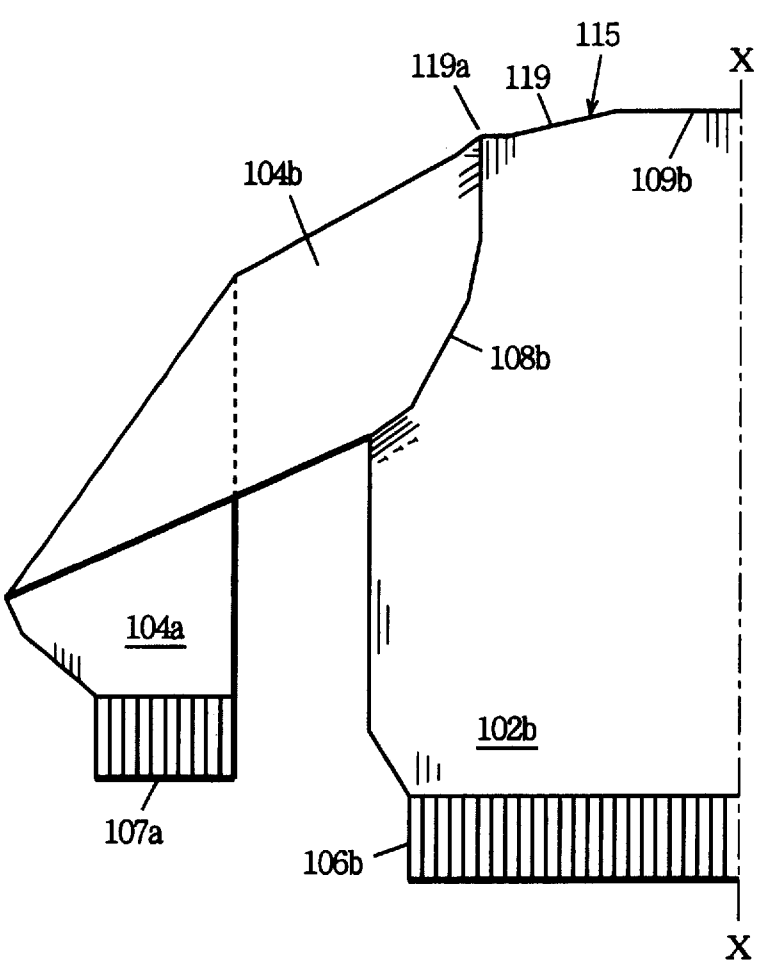
Fig. 11-B (Prior Art)
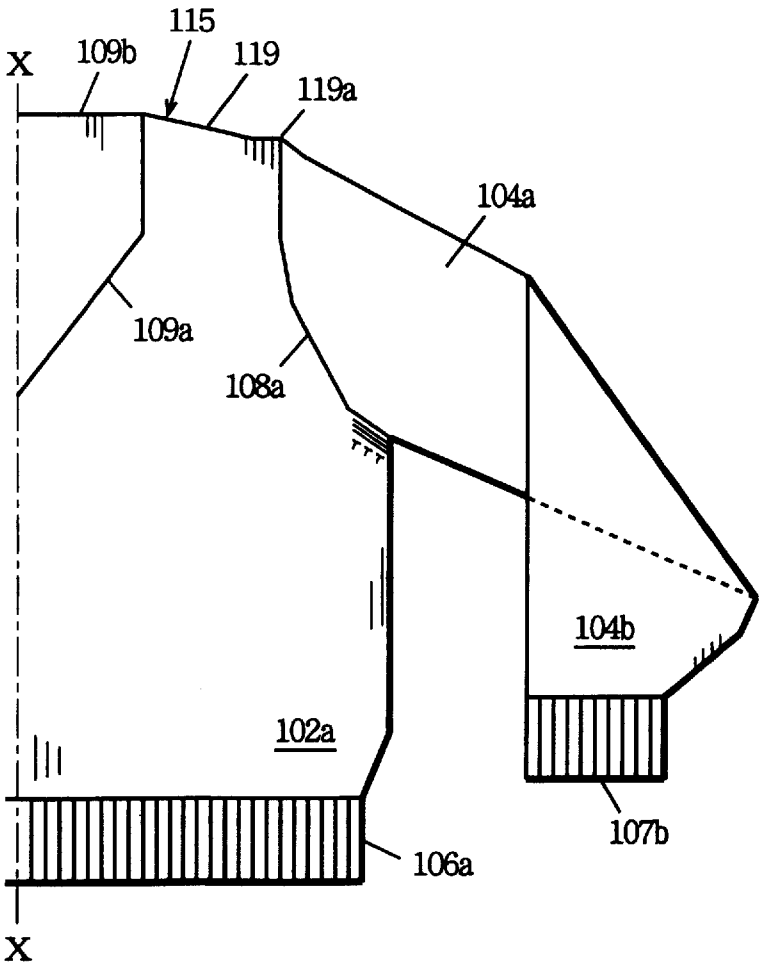
Fig. 11-A (Prior Art)

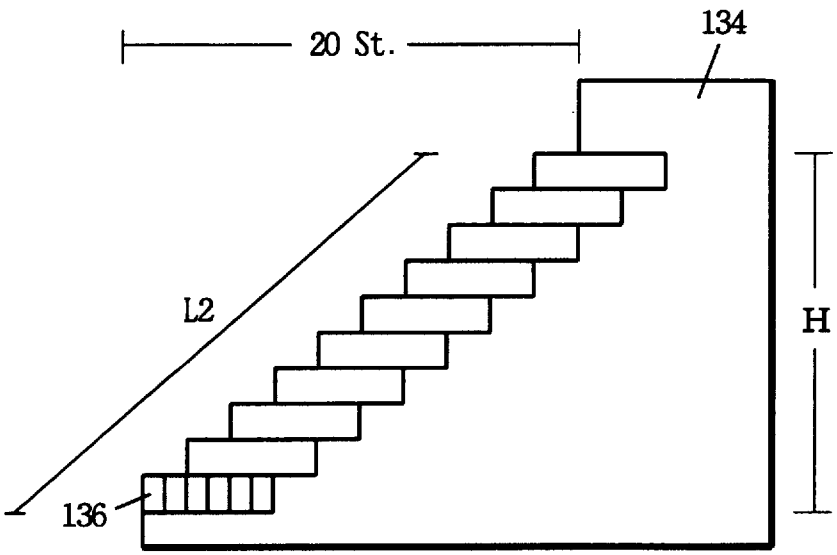
Fig. 13-b
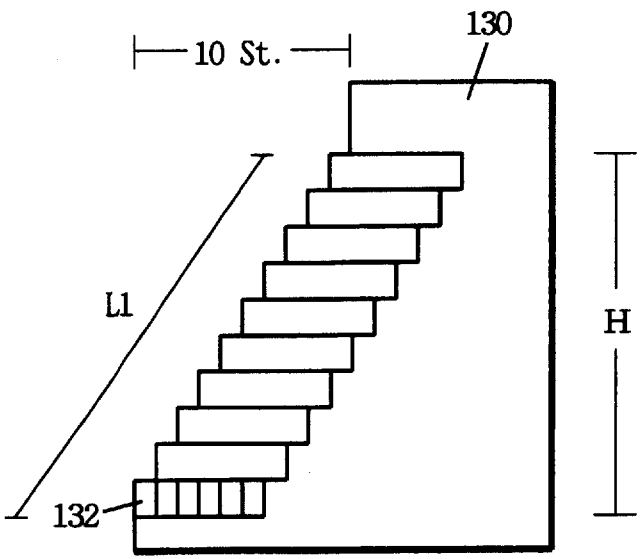
Fig. 13-a

KNITTING METHOD ON A FLAT KNITTING MACHINE AND A KNIT FABRIC THUS PRODUCED

BACKGROUND OF THE INVENTION

1. Field of the Invention

The present invention relates to knitting of garments such as clothing on a flat knitting machine, and in particular, to knitting and joining a front body and a back body of a garment on a flat knitting machine to form a tubular body.

2. Brief Description of the Prior Art

When clothing without sleeves, such as vests, are knitted seamlessly on a flat knitting machine, first a front body and a back body are knitted tubularly from rib hem parts, and knitted up to the shoulder portions, with appropriate openings such as armholes and a neckhole. Then, they are joined at the shoulder portions.

Similarly , when pullovers with both sleeves, such as T sleeves, sit in sleeves, and raglan sleeves are knitted seamlessly, three tubes of the body and both sleeves are knitted simultaneously, and both sleeves are joined to the body around the armholes. Then the front body and the back body, comprising a tube which forms the body, are joined at shoulder portions. These knitting and joining steps are performed on a flat knitting machine. The applicant has proposed such knitting methods in Japanese Provisional Patent Hei 2-91254, Japanese Provisional Patent Hei 2-229248, Japanese Provisional Patent Hei 4-209855 (U.S. Pat. No. 5,456,096), and Japanese Provisional Patent Hei 4-153346 (U.S. Pat. No. 5,379,615).

For example, according to Japanese Provisional Patent Hei 2-91254 and Japanese Provisional Patent Hei 4-209855 (U.S. Pat. No. 5,456,096), the final stitch courses of a front body and a back body, each being held on needle beds of a flat knitting machine, are joined from their one end to the other end so that they are bound-off.

Further, according to Japanese Provisional Patent Hei 2-229248, on a flat knitting machine having at least a pair of needle beds, front one and back one abutting with each other, a tubular body and two tubular sleeves are knitted until the armpits. They are connected into one larger tube. Then, the diameter of the tube is gradually decreased during knitting the newer tube portion, and finally, a pullover with sleeves such as set in sleeves and raglan sleeves is completed. Around armholes, fashion lines appear along the joining portions between the body and sleeves.

When the above knitting methods are applied, knit clothing which is nearly completed are manufactured on a flat knitting machine with decreased necessity of sewing steps such as linking.

FIG. 9 shows parts of a pullover developed as knitted on a flat knitting machine, and the sleeves shown are set in sleeves. In the upper portion of the figure are shown a front body 102*a* and front parts of both sleeves 104*a* and 114*a*, and they are knitted on a front bed when they are plain jerseys. In the lower part of the figure are shown a back body 102*b* and back parts of both sleeves 104*b* and 114*b*; they are knitted on a back bed when they are plain jerseys. Each part shown is symmetrical with respect to a center line X—X, and the front body 102*a* and the back body 102*b* are the same except at the neckhole, having a common body width, a common body length, and a common shoulder width. Points R and Y, and points r and y show the same points, respectively.

FIGS. 10-A and B schematically show knitting steps of the pullover 101, and FIG. 10-B shows the structures of tubes at each stage of P, Q, R, and S in FIG. 10-A.

The tubular knitting is started from the rib hem parts 106,107 and 117 of the body 102 and sleeves 104,114 (position P) and they are knitted simultaneously up to the armpits, while the diameter of the sleeves 104,114 are increased (position Q). At the armpits, the body 102 and the sleeves 104,114 are connected into one larger tube (position R). Then, whenever the larger tube is knitted, for example, two or four courses, stitches of the sleeves 104,114 are moved onto the body 102 so that the moved stitches are overlapped with stitches of the body, and thus the diameter of the tube is decreased gradually. Simultaneously, a neckhole 109 is formed (position S). The sets of points of (L,P), (S, W), (l, p), and (s,w) are the joining points of the body 102 and the sleeves 104,114 at the armpits. Around armholes 108, the front body 102*a* and the front sleeves 104*a* and 114*a* are joined along lines L-M-N and P-Q-R, and lines l-m-n and p-q-r. The back body 102*b* and the sleeves 104*b* and 114*b* are similarly joined along lines S-T-U and W-X-Y, and lines s-t-u and w-x-y. After the joining, portions 111 and 112 are knitted by so-called flechage knitting, wherein, whenever an adequate number of knitting courses are executed, several stitches at both ends are held and kept on knitting needles without further knitting being executed until the final binding-off, and finally both portions are joined and bound-off along lines N-O, U-V, and lines n-o, u-v.

FIGS. 11-A and B show the right half of the pullover knitted with the parts shown in FIG. 9, and FIG. 11-A is a front view and FIG. 11-B is a rear view. FIG. 12 shows the pullover 11 developed around a shoulder line 115. As shown in FIG. 12, the front body 102*a* and the back body 102*b* are joined on the shoulder line 115. However, this joining method on the shoulder line 115 causes various problems on silhouette of the pullover. Since shoulder line 115 is located on the top portion of the clothing when worn, people's line of sight is above the shoulder, and therefore, the joining portion 119 is badly conspicuous. Moreover, the joining portion 119 has a tendency of becoming hard; sleeve connecting point 119*a* in FIG. 11 and the vicinity of the top of the armhole of a vest bulge, resulting in a degraded silhouette of the shoulder line 115. Moreover, when the front body has a colored pattern or a structural stitch pattern, they are interrupted at the shoulder lines and the quality of the pullover is lowered. Furthermore, no fall is formed along the back neck portion 109*b*.

Referring to FIG. 9 the knitting width of the portions 111R,L and 112 decrease as shown along lines O-N, o-n, U-V, and u-v. It is called narrowing to decrease the knitting width of a knit fabric, and there are mainly two methods for narrowing; external narrowing and internal narrowing. In external narrowing, the most outside stitch of a knit fabric is moved by one stitch inward so that it is overlapped with an inside stitch; thus is formed a line of the dual stitches along the edge of the knit fabric. In internal narrowing, a group of stitches, for example, 4 to 7 stitches, at the edge of a fabric are moved inward, and the most inward stitch or the most and second inward stitches of the group are overlapped with one or two stitches unmoved; thus are formed one or two dual stitches. While the edge line of a fabric externally narrowed has sharp turns, one narrowed internally is smooth. Therefore, internal narrowing is more desirable than external narrowing in the quality of products. In internal narrowing, a line of dual stitches is formed inside of an edge of a fabric; it becomes a fashion line. For example, when parts of clothes, such as bodies and sleeves are internally narrowed around armholes, there appear fashion lines. After knitting, such parts are sewn together along the stitches of their edges with a linking machine into clothes such as pullovers. Similarly, internal narrowing is used for the production of clothes without sleeves such as vests.

Internal narrowing is executed during knitting operations of a fabric, and usually, for every two to four courses of stitches knitted, one narrowing operation is executed. The decrease in the knitting width per one narrowing operation is one or two stitches, if the decrease is greater, yarn breakage may be caused.

FIGS. 13 *a–b* show knitted structures of fabrics 130 and 134, with conventional internal narrowing. Larger rectangular portions show stitch groups at a side edge, that are to be moved during internal narrowing. Smaller rectangles in larger rectangles are stitches. 132 denotes a stitch , when one stitch is narrowed with the transfer of six stitches. 136 denotes a stitch, when 6 stitches are transferred and two stitches are decreased in the fabric 134. In both of the fabrics 130,134, two courses of knitting operation are executed for one narrowing operation. As shown in these diagrams, in FIG. 13-*a*, ten wales of stitches are decreased by ten narrowing operations; in FIG. 13-*b*, 20 wales are decreased by 10 internal narrowing operations. Meanwhile, 20 courses of stitches are knitted in both of them. Two stitches may be decreased during one internal narrowing operation at the maximum; the angles of narrowing lines L1 and L2 to the directions of the knitting width show the gradients from stitch rows. The angles are kept no less than that in FIG. 13-*b*. Thus, the design of shaped knit fabrics is restricted in the angles of internal narrowing.

The narrowing lines L1 and L2 are different in length, as shown in FIGS. 13-*a* and *b*; number of stitches necessary along the lines are also different. However, according to conventional internal narrowing, a common number of stitches are arranged along the lines. Moreover, the stitch numbers along the lines are the same to those in the interior of the fabrics. Therefore, knit fabrics shrink along the narrowing lines, and interior stitches are attracted to the edges of fabrics with a result of deformed narrowing lines. This phenomenon becomes more conspicuous when narrowing lines become more acute from one in FIG. 13-*a* to one in FIG. 13-*b*. Such fabrics have distortions resulting in wrinkles in clothes.

SUMMARY OF THE INVENTION

A basic object of the present invention is to knit clothing on a flat knitting machine where joining lines between front bodies and back bodies are not restricted onto shoulder lines of clothes so that joining lines may be arranged away from shoulder lines and where joining lines may be arranged at any angles to shoulder lines.

Another basic object of the present invention is to join sleeves to a body asymmetrically so that knit clothes with various silhouettes may be knitted.

Another basic object of the present invention is to make knit clothes narrowed at any angles to the direction of knitting width without any distortion in narrowing portions. Other objects of the present invention will be clarified in the following descriptions.

According to the present invention, knit clothing is knitted on a flat knitting machine having at least a front needle bed and at least a back needle bed abutting with each other by joining a first body and a second body comprising a tube.

The present invention is characterized by the steps of:

knitting the first body with more courses of stitches than the second body at shoulder portions thereof so that the first body enters into of the second body beyond a shoulder line of the clothing;

knitting shoulder portions and a neck portion of the second body so that the neck portion is made higher than the shoulder portions of the second body; and joining the first and the second body.

Preferably, the knitting of the shoulder and neck portions of the second body is simultaneously done with the joining of the first and the second bodies.

More preferably, the knitting of the second body at shoulder and neck portions comprises the steps of:

knitting only a side edge of the shoulder portions;

knitting a wider range of the second body at the side edge; and while executing the above-mentioned two kinds of knitting, transferring a group of stitches at the side edge inward of the second body and transferring the most outside stitch of the first body so that the most outside stitch and a stitch of the group are overlapped.

Alternatively, the second body may be knitted by flechage at the shoulder and neck portions, and then the first and the second bodies are joined by binding-off.

Preferably, the knit clothing has two tubular sleeves other than the first and the second bodies, the first and the second bodies and the two sleeves are knitted up to armpits of the clothing before the knitting of shoulder portions of the first body and the knitting of the shoulder and neck portions of the second body, from the armpits, around armholes of the clothing, connecting the first and the second bodies and the sleeves into a tube, while knitting the tube, transferring stitches of the sleeves to the first and the second bodies so that the stitches transferred and stitches of the first and the second bodies are overlapped.

then, knitting the first body at the shoulder portions and transferring stitches of the sleeves to the first body so that the stitches transferred and stitches of the first body are overlapped.

Further, the first body is a front body of the clothing, the second body is a back body of the clothing, in the first body, a neckhole is formed, and at the shoulder portions of the clothing, the front body is knitted with more courses of stitches than the back body.

According to the present invention, knit clothing is knitted on a flat knitting machine having at least a front needle bed and at least a second needle bed abutting with each other by knitting a first body and a second body and two tubular sleeves.

The present invention is further characterized by the step of:

knitting the two tubular sleeves and a tube comprising the first and the second bodies up to armpits of the clothing;

from the armpits, around armholes of the clothing, connecting the first and the second bodies and the two sleeves into another tube, while knitting said another tube, transferring stitches of the sleeves to the first and the second bodies so that the stitches transferred and stitches of the first and the second bodies are overlapped, then, knitting a first body, transferring stitches of the two sleeves to the first body so that the stitches transferred and stitches of the first body are overlapped; and then, joining the first and the second bodies at shoulder portions of the clothing.

Preferably, the second body is knitted so that a neck portion of the second body is made higher than shoulder portions of the second body.

According to the invention, a narrowing method on a flat knitting machine for knitting a knit fabric and simultaneously narrowing knitting width of the fabric is provided. The knitting method is characterized by:

a: a step for knitting at least a stitch of a next course on at least a stitch at a side edge of the fabric;

b: a step for knitting stitches of a further next course on stitches of a wider range in the knit fabric than said at least a stitch; and c: a step for transferring said at least a stitch inward of the knit fabric between the steps a and b.

Preferably, said at least a stitch comprises a group of plural stitches at a side edge of the knit fabric.

Preferably, depending on the shape of the knit fabric, namely upon direction of a narrowing line to direction of knitting width of the knit fabric, the number of executing the steps a and c and the number of executing b are changed.

More preferably, the ratio of the number of executing the steps a and c to the number executing the step b is made substantially uniform along the narrowing line, namely the side edge line of the knit fabric where the narrowing is made, so that the narrowing line becomes straight.

Further, the number of executing the steps a and c is determined upon the length of the narrowing line and the size of a stitch of the knit fabric at a portion apart from the narrowing line and perpendicular to the knitting width.

Further, according to the invention, a new knit clothing is provided. The clothing is knitted on a flat knitting machine having at least a front bed and at least a rear bed abutting with each other and is characterized by the following steps for the production:

knitting a body tube comprising a first body and a second body abutting and two tubular sleeves until armpits of the knit clothing;

from the armpits, around armholes of the knit clothing, connecting the body tube and the two tubular sleeves into a further tube, while knitting said a further tube, transferring stitches of the sleeves to the first and the second bodies so that the transferred stitches and stitches of the first and the second bodies are overlapped;

then, knitting the first body further, transferring stitches of the sleeves to the first body so that the stitches transferred and stitches of the first body are overlapped; and then, joining the first and the second bodies at shoulder portions of the knit clothing.

The joining of the front and the back bodies is described. When a first body, for example a front body, is knitted by more times in terms of course number than a second body, for example a back body, at a shoulder port ion, the first body enters into the second body beyond a shoulder line, which appears at the top of the shoulder when a knit clothing is worn . Therefore, the joining portion between the first and the second bodies may be arranged away from the shoulder line with an improved silhouette, and a design in the first body is not interrupted at the shoulder line. The second body is knitted at the shoulder and neck portion so that the neck portion rises higher than the shoulder. As a result, the shoulder fall is formed. Therefore, knit clothes without interruption in the design at the shoulder line and with improved silhouette are knitted on a flat knitting machine.

For the second body, both knitting of only a shoulder edge and a wider range are done, the stitches of the shoulder edge are transferred inward in the second body, and the knitting width of the second body decreases. Furthermore, the most outside stitch of the first body is moved to the side end of the second body so that the two bodies are joined. When this joining method being different from conventional flechage is used, taking down force to the stitches is uniform along the stitches, and the two bodies are joined easily. Moreover, the formation of the shoulder fall and the joining of the two bodies are done simultaneously.

Preferably, the first body is made a front body, and the second body a back body then the front body is knitted more times in terms of course number in shoulder portions than the back body, and as shown in FIG. 3, the front body enters beyond the shoulder line into the back side of clothing. The back body is knitted so that its neck portion is higher than its shoulder portions. The shoulder falls are on the shoulder line (FIG.3), and since the neck portion of the back body is lower than that of the front body, the fall in the back is formed.

In joining of both sleeves to the body above the armpits, stitches of both sleeves are moved to the first and the second bodies and the knitting width of both sleeves is made decreased gradually. Then, the first body is knitted, and the remaining stitches of the both sleeves are moved to the first body. For example, if the front body is the first body, the front body is knitted, and the stitches of both front sleeves are moved towards the front body, and finally, the stitches of both back sleeves are also moved towards the front body. Thus, the sleeves are asymmetrically joined to the body.

According to the invention, a new method for narrowing is provided for knitting the second body, and the method may be used for narrowing other portions than the second body. Terms on narrowing are described; "at least a stitch at a side edge of a fabric" is, for example, one to ten stitches at a side edge of a fabric, preferably three to ten stitches, and more preferably four to ten stitches. External narrowing is to move a side edge stitch inward; internal narrowing is to move plural stitches at a side edge inward. A line along a side edge where narrowing is done is called a narrowing line. Stitches along the entire knitting width or at least a wider range than the side edge stitch group is called a group of stitches of a wide range. A course is a stitch row arranged along the knitting width and especially, a stitch row formed by one knitting operation. A dress pattern may be a literal dress pattern or pattern data generated by a CAD apparatus designating the forms of fabric to be knitted and so on. Since narrowing is the subject of the present invention, those relating to narrowing are described without reference to other portions.

When a knitting course is added only for the side edge, the number of stitches along a narrowing line is increased by one than that of the other portion. Along the narrowing line, stitches are transferred inward, and the direction of them is changed. Therefore, more stitches are needed in the vicinity of narrowing portions than in other portions to knit fabrics without distortion. And the required additional stitches are supplied by the knitting of said at least a stitch at the side edge so that the distortion is prevented.

Narrowing itself is done by inward transfer of said at least a stitch at a side edge, and the length of the transfer is preferably one or two stitches. The addition of the knitting of only the side edge stitch group or the side edge stitch allows additional narrowing operation. Therefore, at any desired angle to a knitting width, narrowing may be performed.

For making the fabric without distortion, it is necessary to select the number of stitches along the narrowing line. A transferred stitch by external narrowing may be expanded with a result of less distortion, and internal narrowing poses a problem. The stitches of side edge stitch group transferred by internal narrowing are parallel to the direction of the narrowing line, hence the necessary number is determined upon the length of the narrowing line and the stitch size along the line. The stitch size is determined upon the size of a stitch perpendicular to the knitting width where no narrowing is done and therefore the stitch is natural. Preferably, the necessary stitch number along the narrowing line is determined upon the length of the line and the stitch size. The number is the sum of knitting courses for the side edge stitch group and the knitting courses of the wider range.

When a dress pattern showing a fabric design is decided, the length of a narrowing line and the height of the fabric in the narrowing portion are determined. The height gives the knitting course number for the wide range knitting. The length of narrowing line gives the sum of knitting course numbers of the wide range knitting and the side edge knitting. Thus, the knitting course number of the side edge stitch group is decided. The dress pattern gives the width to be decreased, and the width is determined by the number of transfer operate of the side edge stitch group, and the stitch number decreased by one transfer. Then, when the three steps of knitting of the side edge stitch group, knitting of the wide range stitch group and the transfer of the side edge stitch group are regularly repeated, a desired narrowing line is obtained. For example, when the three steps are evenly arranged along the narrowing line, a straight uniform narrowing line is obtained.

Therefore, narrowing without distortion of fabric at a desired angle is performed. Preferably, the knitting course number of side edge stitch group, the knitting course number for the wide range and the transfer number of the side edge stitch group are determined upon the stitch size and the dress pattern. If narrowing data thus obtained is inadequate in some details, the design of the fabric and so on may be adjusted so that adequate narrowing may be done. Thus, narrowing is made easy. Further, if the knitting of the side edge stitch group (additional knitting), the knitting of the wide range (usual knitting), and the transfer of the side edge stitch group (narrowing) are arranged, desired curves are obtained by narrowing.

BRIEF DESCRIPTION OF THE DRAWINGS

FIGS. 2-A,B show a knitted pullover: FIG. 2-A is a front view of the right half of the pullover; and FIG. 2-B is a rear view of the right half of the pullover.

FIGS. 10-A, B show knitting procedures of a pullover according to a conventional method: FIG. 10-A shows knitting stages; and FIG. 10-B shows end views of the body and sleeves at various stages shown in FIG. 10-A.

FIGS. 11-A,B show the right half of a pullover knitted according to the conventional method: FIG. 11-A is a front view; and FIG. 11-B is a rear view.

FIGS. 13-*a,b* show a knit fabric knitted according to a conventional internal narrowing method.

DETAILED DESCRIPTION OF THE PREFERRED EMBODIMENTS

A first embodiment is described with reference to FIG. 1–FIG. 5. In this embodiment, a pullover with set in sleeves and having a plain structure is knitted.

Figure 1:
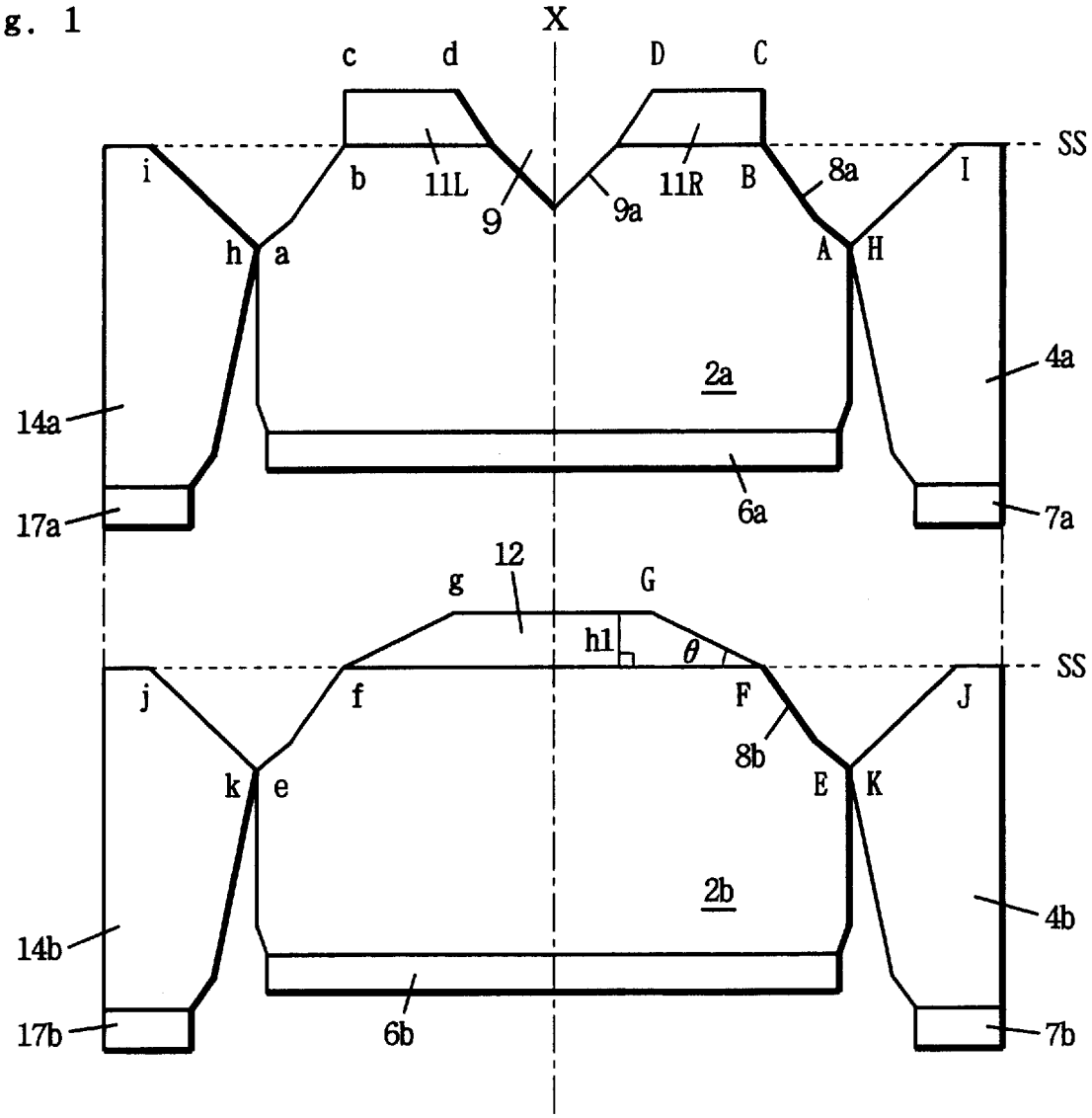
FIG. 1 shows parts of a pullover arranged as knitted on a flat knitting machine: the upper part shows a front body and both front sleeves to be knitted on a front needle bed; and the lower parts shows a back body and both back sleeves to be knitted on a rear bed.

In FIG. 1, the parts of a pullover 1 are arranged as knitted on a flat knitting machine: in the upper portion, the front body 2*a* and the front sleeves 4*a*, 14*a*, which appear in the front side of a human body, are knitted on needles of a front bed of a flat knitting machine. In the lower portion, the back body 2*b* and the back sleeves 4*b*, 14*b*, which appear backward, are knitted on needles of a rear bed of the flat knitting machine. A line X—X is the center line of the pullover 1; the pullover 1 is symmetric with respect to the center line. Symbol 9 shows a neck hole, and symbols 6, 7 and 17 show rib hem parts.

Points A, H, points E, K, points a, h, and points e, k are joining points between the body 2 and sleeves 4 and 14 at the armpits. Around armholes 8*a, b*, the front body 2*a* and the sleeves 4*a* and 14*a* are joined along a line A-B, a line H-I, a line a-b, and a line h-i, and the back body 2*b* and the sleeves 4*b* and 14*b* are joined along a line E-F, a line K-J, a line e-f, and a line k-j. It should be noted that the front body 2*a* and the back body 2*b* are different in shape at portions 11,12 which are above the points B,b,F and f. Namely, the sleeves are joined to the front body 2*a* at their sleeve cap portions I-J and i-j and a line B-C and a line b-c of a portion 11 of the front body 2*a*. Moreover, the front body 2*a* and the back body 2*b* are joined along a line C-D, a line F-G, a line c-d, and a line f-g.

The pullover 1 thus knitted by using these parts is shown in FIG. 2. FIG. 2-A is a front view of the right half of the pullover 1 , and FIG. 2-B is the back view of the right half thereof. It is developed around a shoulder line 15 in FIG. 3. As is clear from FIG. 3, the front body 2*a* goes beyond the shoulder line 15 and enters into the back body 2*b*. Moreover, a fashion line 20 which consists of a predetermined number of wales is formed along a joining portion 19 between the front body 2*a* and the back body 2*b*.

As is already described, it is known to knit the body 2, and the sleeves 4 and 14 tubularly and to join the body 2 and the sleeves 4,14 during the knitting so that nearly completed article is produced on a flat knitting machine. When a so called two bed flat knitting machine is used, the needles of both beds having odd numbers are assigned to the front body and so on, and needles of both beds having even numbers are assigned to the back body and so on. Thus, one per two needles is used, and each stitch of a fabric has an empty needle for stitch transfer on the other bed than the bed where the stitch is held . Therefore, structural stitch patterns having both face stitch and back stitch such as links, garter, and rib patterns are easily knitted. Moreover, the empty needles allow to transfer both sleeves to a body for joining them. When a so-called four beds flat knitting machine is used, a front body is knitted on the lower front bed and the upper rear bed, and similarly, a back body is knitted on the lower back bed and the upper front bed. Thus, it is not necessary to restrict needle allocation in a four bed machine; all needles of lower front and back beds may be used.

The pullover 1 is knitted from the rib hem parts 6*a*, 6*b*, 7*a*, 7*b*, 17*a* and 17*b*, and they are knitted tubularly with yarn feeders being reciprocated. Then, the body 2 and the sleeves 4, 14 are knitted till armpits. When a desired number of knitting courses are executed, the wale numbers are increased. At the armpits, the tubular body 2 and the tubular sleeves 4, 14 are connected, and then, around the armholes, whenever a predetermined number of knitting courses are executed, the sleeves 4, 14 are transferred to the body 2 by a predetermined number of stitches, and stitches of the body and the sleeves are overlapped along the armholes 8*a*, 8*b*. Thus, the front body 2*a* and the front sleeve 4*a* are joined on lines A-B and H-I, and the back body 2*b* and the back sleeve 4*b* are joined on lines E-F and K-J. The front body 2*a* is joined with the front sleeve 14*a* on lines a-b and h-i, and the back body 2*b* is joined with the back sleeve 14*b* on lines e-f and k-i. Therefore, the knitting widths of both sleeves 4, 14 are decreased gradually during the knitting operations, and the neckhole 9*a* is formed simultaneously.

Figure 4:
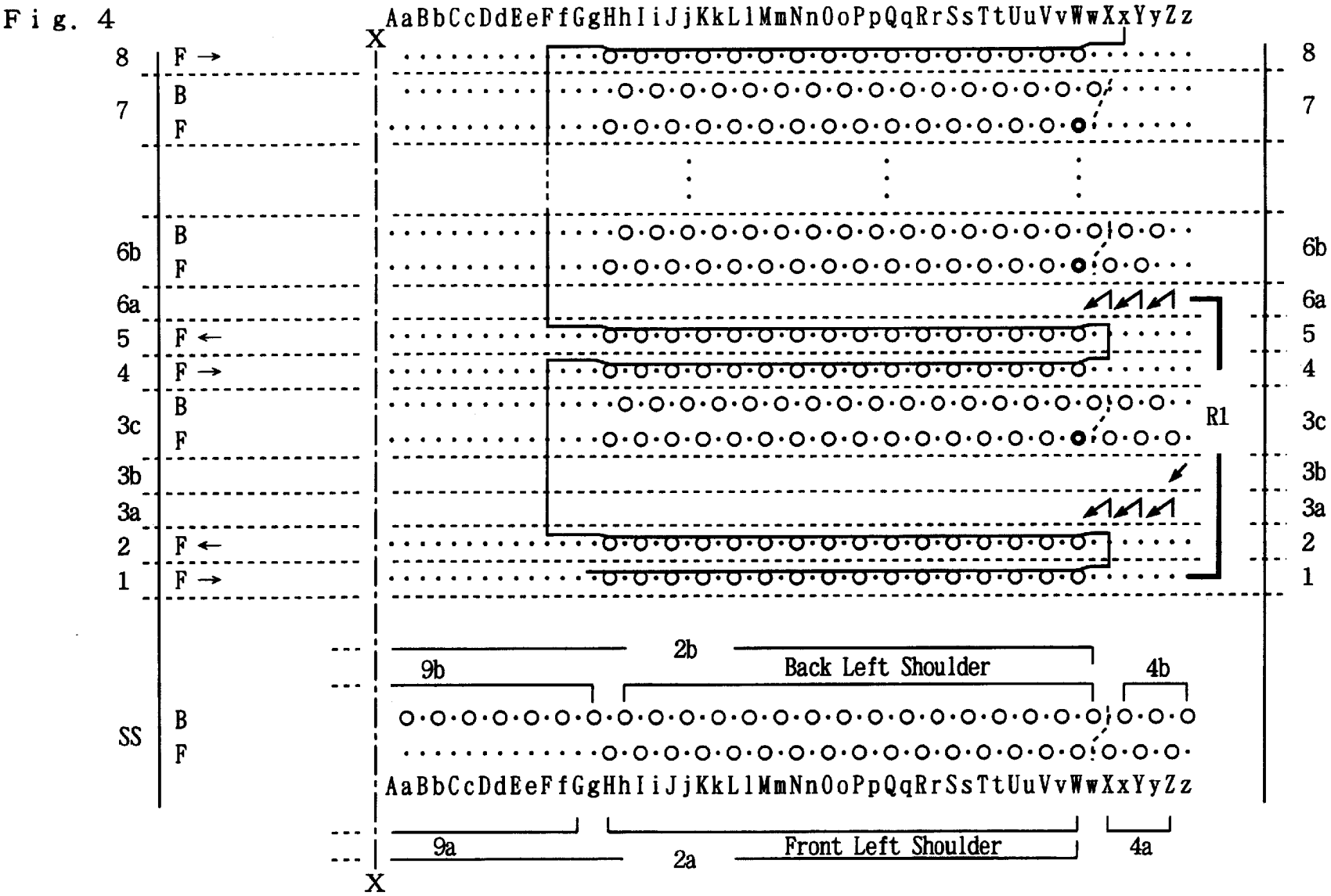
FIG. 4 is a knitting block diagram of the pullover where the front body and the left sleeve, etc. are joined.
Figure 5:
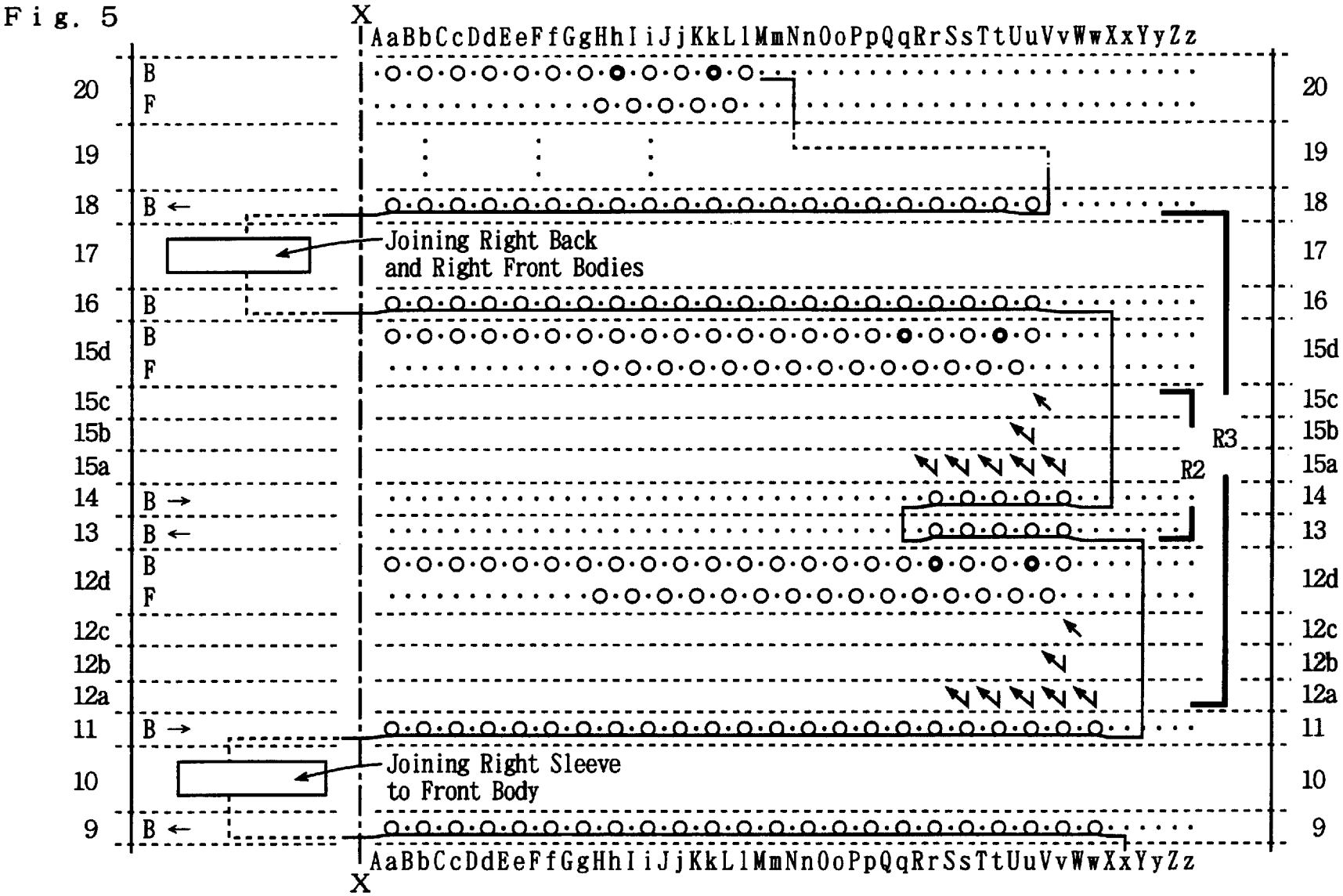
FIG. 5 is a knitting block diagram of the pullover where the front body and the back body are joined.

FIGS. 4 and 5 show knitting blocks according to the embodiment, and characters in the top and bottom of each figure show the needles on the needle beds at a state without racking, and the front body 2*a*, and the front-side sleeves 4*a*,14*a* are knitted with needles of odd numbers indicated by capital letters. The back body 2*b* and the back-side sleeves 4*b*, 14*b* are knitted with needles of even numbers indicated by small letters. F in the left of the figures shows the front bed, B the back bed, and the arrows the direction of knitting. The number of needles shown is less than that actually arranged for the simplification of description. The right half of the pullover 1 is described since the pullover 1 is symmetric.

The state SS of FIG. 4 corresponds to the state SS in FIG. 1 and shows the stitch allocation at the state. On needles H, I, J, . . . , U, V, W of the front bed, the stitches of the left shoulder part of the front body 2*a* are held, and the stitches of the sleeve 4*a* are held on needles X, Y and Z. Similarly, on needles a, b, c, . . . , u, v, w of the back bed, the stitches of the left half of the back body 2*b* are held, and the stitches of the sleeve 4*b* are held on needles x, y and z. The stitches of the left sleeves 4*a*, 4*b* on the sleeve cap line I-J are shown by six wales: on needles X, Y, Z, z, y, and x.

From the state SS, knitting operations shown as blocks 1 to 10 (FIG. 5) are done, during them the portion 11R of the front body 2*a* is knitted, and the front body 2*a* is joined with the left sleeves 4*a*, 4*b*, while the line I-J of the sleeves 4*a, b* is overlapped with the line B-C of front body 2*a*. The stitches of the left sleeves 4*a, b* are shifted to the front body 2*a*, and they are overlapped with the stitches of front body 2*a* by one stitch whenever two knitting courses of the portion 11R are knitted. No new stitches are formed in the sleeves 4*a, b* or in the back body 2*b* during these operations.

During blocks 1 and 2, needles H, I, J, . . . , U, V and W, and needles W, V, U, . . . , J, I and H of the front bed are fed with the yarn, and two courses of stitches are formed in the portion 11R of the front body 2*a*. Next, in a block 3*a*, the stitches of the sleeve 4*a* held on needles X, Y and Z of the front bed are once transferred to the rear bed, and they are retransferred to needles W, X and Y of the front bed. In a block 3*b*, the most outside stitch of the back sleeve 4*b* held on a needle z of the back bed, which is adjacent to the most outside stitch of the front sleeve 4*a*, is transferred to a needle Z of the front bed. The stitches of the back sleeve 4*b* are moved to the front bed according to the movement of the front sleeve 4*a* so that the yarn of the sleeve is not excessly prolonged. The stitches on the needle beds after the above operations are shown in a block 3*c*, a needle W holds the most outside stitch of the front body 2*a* and the most outside stitch of sleeve 4, and thereby, one wale of the sleeve is decreased. A double stitch is shown with a double circle.

In blocks 4 and 5, needles H, I, J, . . . , U. V and W of the front bed F and the needles W, V, U, . . . , J, I and H are fed with the yarn so that the front body 2*a* is knitted by two courses. In the subsequent block 6*a*, the stitches of the front sleeve 4*a* held on needles X, Y and the stitch of the back sleeve 4*b* held on a needle Z of the front bed are moved onto needles W. X and Y in of the front bed, as was similarly done in the block 3*a*. However, further stitch transfer from the rear bed to the front bed, as shown in the block 3*b*, is not required. In a block 6*b*, the state of stitches after the above operation is shown; on the needle W the side edge stitch of the front body 2*a* and the stitch of the sleeve 4 are held, and the sleeve 4 is further decreased in wale number by one. A knitting cycle shown as RI consisting of blocks 1 to 6*a* is repeated till all wales of the sleeve 4 are moved and the sleeve 4 is completely joined to the front body 2*a*. Thus, the portion 11R of the front body 2*a* is knitted, and stitches of the sleeve 4 along the line I-J are joined to the stitches of the front body 2*a* along the line B-C sequentially. In a block 7, is shown the state after the joining between the left shoulder 4 and the front body 2*a*.

Before the right sleeve 14 is joined to the front body 2*a*, in a block 8, the yarn is fed to needles H, I, J, . . . , U, V, and W of the front bed, and the final course of the portion 11R, corresponding to the line D-C, is knitted. Then, in the next block 9 shown in FIG. 5, the yarn is fed to needles w, v, y, . . . , c, b and a of the back bed so that one course of the back body 2*b* is knitted. And in a block 10, a similar knitting cycle to that done in the blocks 1–6*a* is executed at the right shoulder so that the portion 11L of the front body 2*a* is knitted and the right sleeve 14 is joined to the front body 2*a*. As the result, both sleeves are joined to the front body , and the sets of joining points (C,J) and (c,j) are beyond the shoulder line 15.

Then, the front body 2*a* and the back body 2*b* are joined at the shoulder. The portion 12 of the back body 2*b* is knitted with narrowing, and simultaneously, both bodies are joined with the prevention for the joint 19 from ravelling. No new stitches are formed in the front body 2*a*. The portion 12 is a trapezoid and is higher at the neck portion than at the armhole portion, since a greater number of knitting courses are done at the neck portion. The front body 2*a* and the back body 2*b* are joined in lines C-D and F-G and in lines c-d and f-g, and the inclination along the lines F-G and f-g makes shoulder falls.

After the joining between the right sleeve 14 and the front body 2*a*, the front body 2*a* and the back body 2*b* are joined along the lines C-D and F-G. In a block 11, needles, . . . , a, b, c, . . . , u, v and w of the rear bed holding the back body 2*b* are fed with the yarn so that one course of stitches are knitted from the left to right. Then, in a block 12*a*, a right side edge stitch group 20*a*, comprising five wale stitches of the back body 2*b* and held on needles s, t, u, v and w of the rear bed, are transferred onto needles r, s, t, u and v of the rear bed via the front bed. Thus, the most inner stitch of the side end stitch group is overlapped with a stitch of back body 2*b* held on the needle r, and the back body is narrowed by one wale. Then, in a block 12*b*, the side end stitch of the back body 2*b*, transferred to the needle v, is once more transferred to the needle u of the rear bed. As a result, the most outside stitch and second outside stitch of the side end stitch group 20*a* are overlapped with further decrease in the wale number by one. In subsequent block 12*c*, the most outside stitch of the front body 2*a* held on the needle W of the front bed is transferred to the needle v of the rear bed. As shown in a block 12*d*, the front and back bodies are decreased in wale number each by one.

In a block 13, the yarn is fed to needles v, u, t, s and r holding the side end stitch group of the back body and the most outside stitch of the front body, both already transferred, and one course of stitches are knitted for the side end stitch group 20*a*. Thus, a stitch of the front body is joined to a stitch of the back body. This joining between both bodies results in the beautiful joining line 19 with less bulge. Here, the operation in the block 12*b* may be omitted so that the most outside stitch of the front body 2*a* may be overlapped with the most outside stitch of the back body 2*b* held on the needle v.

As described above, with the transfer of side edge stitch group, the knitting width of the back body is decreased, the back and front bodies are joined, and there appears a fashion line along the joining line 19.

In a block 14, needles r, s, t, u and v are fed with the yarn so that a new stitches are formed to the side end stitch group 20*a*. In a block 15*a*, the stitches thus formed are transferred to needles q, r , s, t and u via the front bed. Then in a block 15*b*, a stitch held on the needle u is transferred onto the needle t for making a dual stitch. In a block 15*c*, the most outside stitch of the front body 2*a* held on the needle V is transferred onto the needle u of the rear bed. Thus, the front and back bodies are decreased in their wale numbers, each by one, from the state shown in the block 12*d*.

Then, in a block 16, a new row of stitches are formed to the back body. In a block 17, the front body 2*a* and the back body 2*b* are joined similarly in the right halves. When the block 17 is finished, two stitches of each end of front and back bodies are joined.

In a block 18, needles of rear bed are fed with the yarn for knitting a course of stitches in the back body. In a block 19, a knitting cycle R3 comprising the blocks 12*a* through 18 is repeated until the portion 12 is knitted and the front and the back bodies are joined till the beck portion 9. Block 20 shows the state after the above knitting, where needles H, I,J,K and L of the front bed hold side end stitches of the front neck portion 9a, and needles a, b , c , . . . , j , k and l of the rear bed hold the stitches of the rear neck portion 9*b*.

On the remaining stitches, stitches of thermally dissolvable yarn are formed by several courses. The fabrics joined are removed from the knitting machine and are prevented from ravelling by thermal treatment for dissolving the thermally dissolvable yarn. As an alternative method, the fabrics joined may be bound-off on the knitting machine. After the above treatment, a collar may be joined on the flat knitting machine.

The knitting width of the body 2 decreases by two stitches respectively at the right and left ends by one operation of knitting cycle R3 during the knitting of port ion 12. However, when the number of cycles R2, comprising the blocks 13 to 15*c*, is increased per cycle R3, a greater number of stitches are decreased. The height h of the portion 12 is changed by the repetition number of the cycle R2, and it decreases when a greater number of cycle R2 are repeated. When the height h decreases, the gradient θ of the portion 12 becomes more acute, and as a result, the angle between the joining line and the shoulder line becomes smaller. Thus, the angle may be adjusted at any value, and various silhouettes may be obtained by changing the height h and the repetition number of cycle R2.

Figure 3:
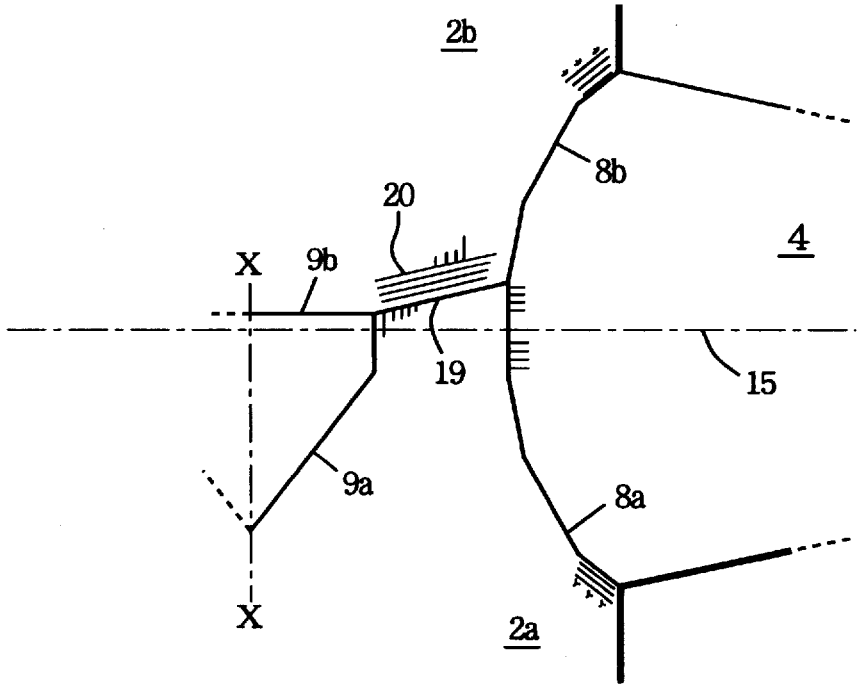
FIG. 3 shows the pullover developed around the shoulder line.

As shown in FIG. 3, the front body 2*a* enters into the back body 2*b*, the shoulder fall is formed on the shoulder line 15, and the shoulder fall point is at the center point between the point C and B shown in FIG. 1. As shown in FIG. 3, the rear neck portion 9*b* is beyond the shoulder line 15, since the portions 11R and 11L are knitted with more courses than the portion 12. Therefore, points D and d in FIG. 1 are at higher positions than points G and g. For example, the points D, G are at the intersection of neck portions 9*a* and 9*b* of FIG. 3. Therefore, the line G-g in FIG. 1 forms the rear neck portion 9*b* in FIG. 3, and a fall is formed in the rear neck portion 9*b*.

In place of the above knitting process, the portion 12 may be knitted by flechage. In flechage, the knitting width of portion 12 is gradually decreased during the knitting of portion 12 by keeping the stitches at both ends held on needles without any operation. Then, the stitches of the portion 12 held on needles are joined with stitches of the front body 2*a* so that the both bodies are bound-off.

However, in the flechage, stitches formed in rather previous courses are held on needles together with the stitches newly formed. Therefore, the take down force from a take down roller is not evenly applied to each stitch, and the knitting becomes difficult. On contrary to this, according to the method shown in FIG. 5, the portion 12 is knitted simultaneously with the joining between both bodies, the take down roller pulls down each stitch evenly, and the knitting operation is easier than the flechage. Further, desired joining angles may be obtained.

In the embodiment, the pullover 1 with plain stitch structure was described. Therefore, stitch transfer between the beds for rib stitch knitting was not required. However, the above stitch transfer may be added for knitting pullovers having both face and rear stitches such as wide rib patterns. Shapes of sleeves are not limited to set in sleeves described above, and other sleeves such as T sleeves may be knitted. For knitting T sleeves, above the armpits, no stitches of sleeves are knitted, and the sleeves are joined to a body in the state that the stitches of body and sleeves are orthogonal to each other. Clothes such as vests may be knitted according to the embodiment without knitting sleeves.

EMBODIMENT 2

Figure 6:
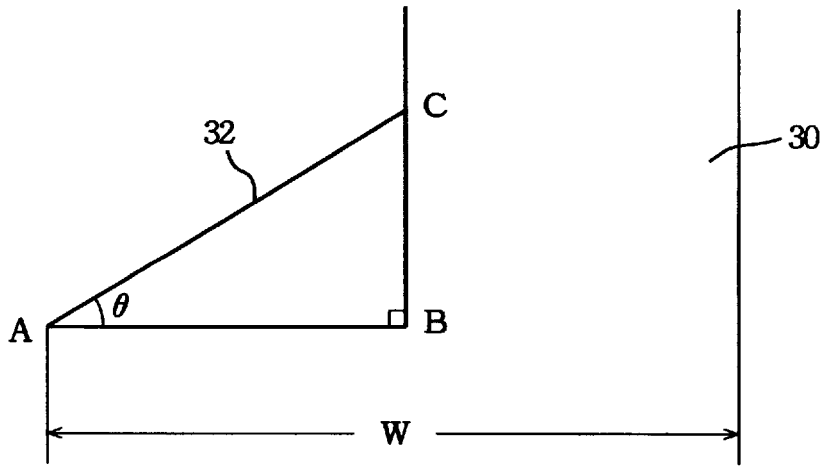
FIG. 6 shows an internal narrowing design according to a second embodiment.

An embodiment relating to narrowing is described with reference to FIG. 6–FIG. 8. FIG. 6 shows a design for a narrowing line 32 in a dress pattern 30 and there are shown a segment AB representing the knitting width in the narrowing portion, a segment BC representing the knitting height in the same portion, and another segment AC representing the narrowing line 32. A narrowing method according to the dress pattern 30 and using stitches of a predetermined size is described. Stitch size may be obtained, for example, from stitch numbers per 10 cm×10 cm area of a knit fabric. As is described in Japanese Provisional Patent Hei 7-133562 (U.S. Pat. No. 5,511,394), several texture samples are knitted with different stitch sizes, the best sample is selected, and the stitch size in the best sample is used. Upon this stitch size, stitch numbers in the dress pattern for the segments AB and BC and for the knitting width W are determined.

Upon the sizes in the dress pattern and the size of stitch, the following data are obtained. The length of segment AB shows the number of stitches to be decreased, which depends upon the number of narrowing courses and whether one stitch or two stitches are decreased by one narrowing operation. The length of segment BC shows the number of usual knitting courses.

The length of the narrowing line 32, namely the length of segment AC, is determined by the sum of usual knitting courses and the local knitting courses. In the vicinity of the narrowing line 32, stitches are parallel to the line 32, and this is the direction of a side edge stitch group. Thus, a stitch number along the narrowing line 32 for knitting a fabric without distortion is determined upon the length of segment AC by dividing the length by the stitch size. The stitch size is determined by the best sample and is one along the wale direction. The size may be obtained as the size of a stitch along a direction perpendicular to the knitting width in a area without distortion. The number of local knitting courses is obtained by subtracting the stitch number along the segment BC from that along the segment AC. Thus, the numbers for local knitting, usual knitting, and narrowing courses are determined.

The stitch number along the segment AC may be determined by the product of stitch number along the segment BC and the ratio of the length AC to the length BC. For example, when the length AC is double of the length BC, then the stitch number along the length AC is double of that along the length BC. However, knitted fabrics are easily stretched, and therefore, a shift in stitch numbers of about ±10% is allowable; the resultant distortion along the segment AC is not conspicuous.

The knit fabric W is knitted so that the narrowing line 32 is regularly produced. For example, when the local knitting courses, the narrowing courses, and the usual knitting courses are evenly distributed along the line 32, a straight and regular narrowing line 32 is resulted. Whether a desired knit fabric according to the dress pattern can be obtained or not depends upon stitch size, and it is preferable to adjust the segment lengths BC and AB, if the distribution of local knitting courses and the narrowing courses, etc. generates fractions. Moreover, adjustment may be made by selecting one stitch or two stitches per one narrowing course.

Figure 7:
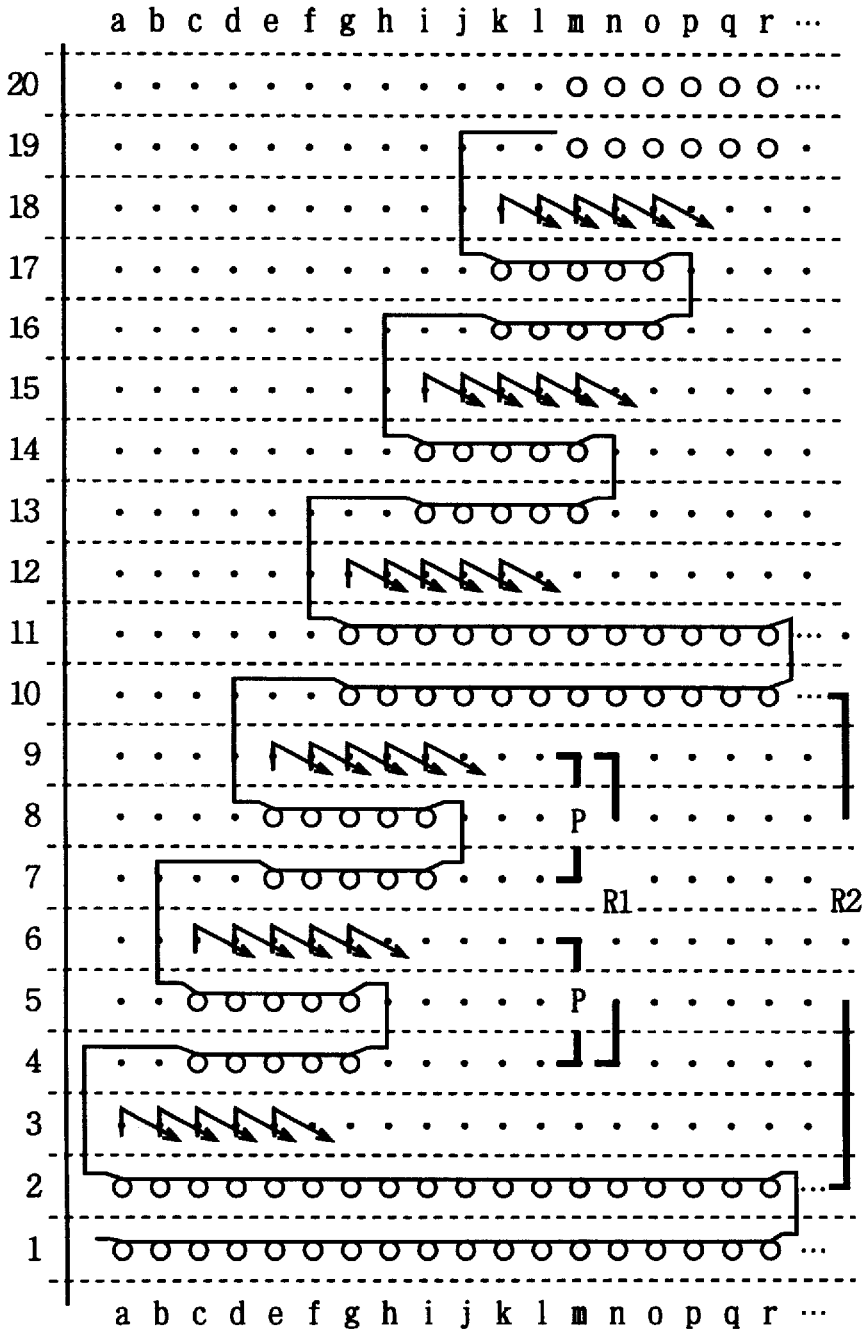
FIG. 7 is a knitting block diagram of the second embodiment.

FIG. 7 shows an example of knitting blocks where the length of segment AC is set at three times that of segment BC upon the pattern data and the stitch size. There, when the knit fabric is knitted usually by two courses, four courses of local knitting are executed, and during these knitting courses, a narrowing course of two stitches is executed three times.

Shaped knitting with internal narrowing is started from blocks 1 and 2 in FIG. 7, there yarn is fed to all needles a through r holding the fabric and two courses of stitches are formed along the entire width of the fabric. The arrows in a block 3, etc. show the direct ion of stitch transfer, and in the block 3, a side edge stitch group comprising five stitches held on needles a through e of the front bed are transferred via the rear bed to needles c through g on the same bed with a right shift of two pitches of needles. Thus, the knitting width is decreased by two stitches.

Then, in blocks 4 and 5, the needles c through g holding the side end stitch group K are fed with the yarn so that two stitch courses are formed there. In a block 6, the stitch group is once more shifted to the right by two pitches with further decrease in knitting width by two stitches. The above cycle of blocks 4 to 6 (a cycle P in a larger cycle R1) is once more repeated in blocks 7 to 9, and further two stitches are decreased.

In a block 10, one stitch course is knitted along the entire knitting width W.

Then a narrowing cycle R3 corresponding to the blocks 2 to 10 is repeated, and the narrowing line 32 is formed.

Thus the usual knitting courses and the local knitting courses are regularly distributed. Therefore, the stitch number along the narrowing line 32 is more than that along the segment BC, and the knitting width is decreased. Therefore, the resultant knit fabric has a shape according to the dress pattern and has no distortion.

Figure 8:
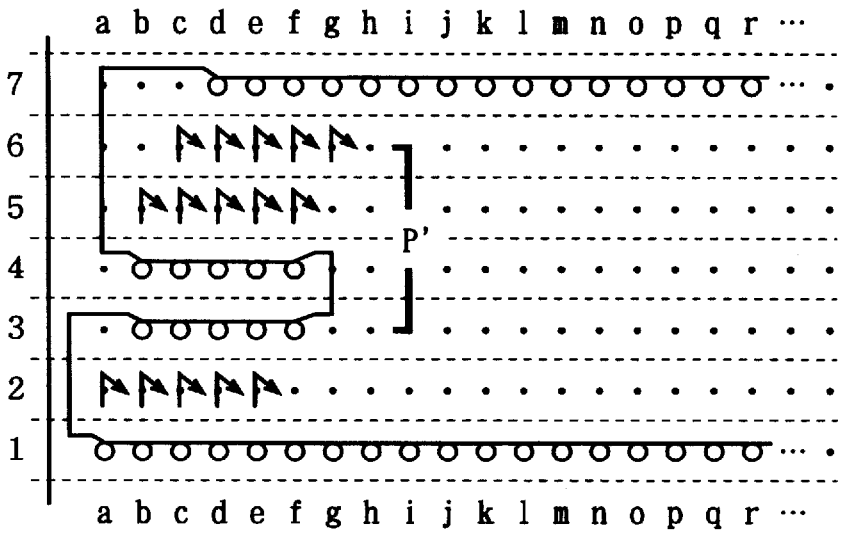
FIG. 8 is a knitting block diagram according to a version of the second embodiment.
Figure 9:
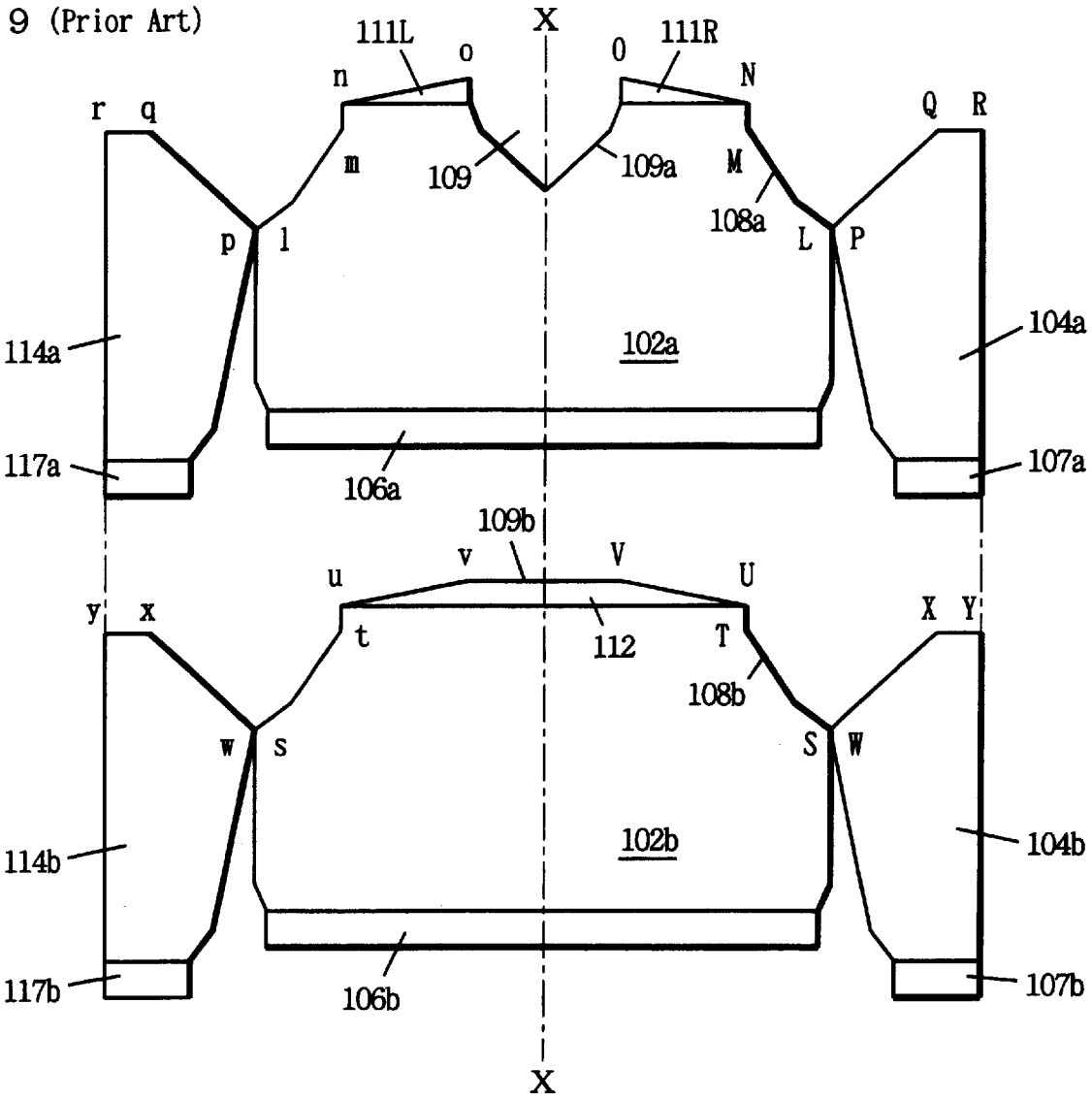
Fig. 9 (Prior Art)
FIG. 9 shows parts of a pull over to be knitted according to a conventional method.
Figure 12:
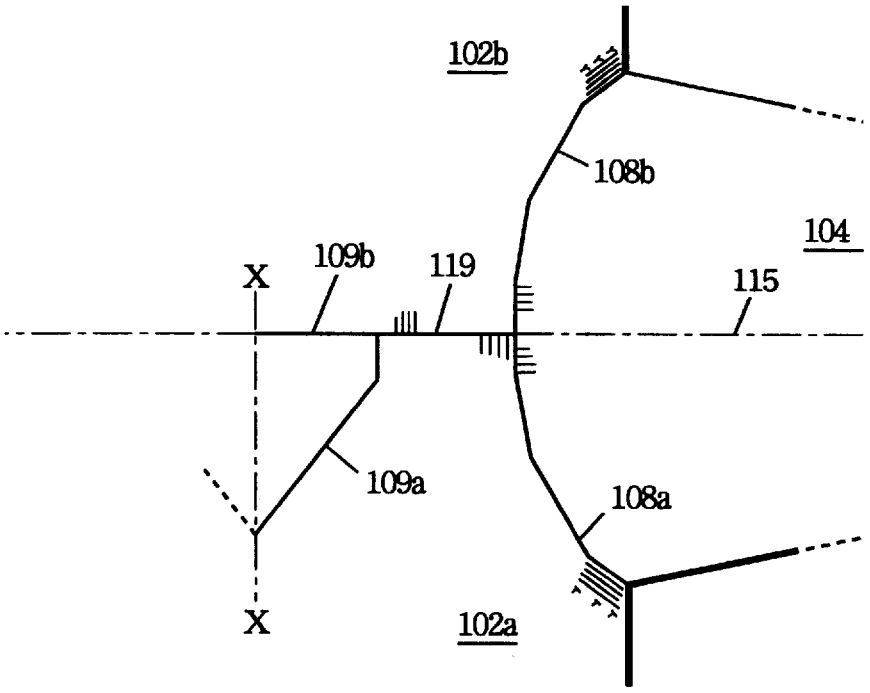
Fig. 12 (Prior Art)
FIG. 12 shows the pullover expanded around the shoulder line and knitted according to the conventional method.

FIG. 8 shows a version of the above narrowing cycle R2, where the stitch number along the segment AC is twice of that along the knitting height (the segment BC). In the version, whenever two courses of usual knitting are done, two courses of local knitting for three side edge stitches are done, and the stitch number is decreased by three. While in FIG. 7 the subcycle P is executed twice per one narrowing cycle R1, in FIG. 8 one narrowing cycle P' similar to the subcycle P is executed.

First, in a block 1 needles p through a are fed with the yarn so that one stitch course is formed along the entire knitting width. Then, in a block 2, the side end stitch group held on the needles a through e of the front bed is moved via the rear bed to needles b through f of the front bed with one pitch right shift. Thus, the knitting width is decreased by one stitch.

Then, in blocks 3 and 4, two local knitting courses are executed on the side end stitch group. In a block 5, the side end stitch group is shifted to the right by one stitch and is held on needles c through g of the front bed. Then, in a block 6, the stitch group is moved onto needles d through h with a further decrease by one stitch. In a block 7, all needles holding the fabric are fed with the yarn so that one course of stitches are formed.

As is clear from the above examples, the numbers of local knitting courses and narrowing courses are adjusted according to the angle of the narrowing line. When the angle is more acute, the decrease in the stitch number per the height of fabric becomes larger, and the number of narrowing courses becomes larger. According to the invention, the knitting width may be rapidly decreased by increasing the ratios of numbers of local knitting courses and narrowing courses to the number of usual knitting courses. Therefore, narrowing with a desired angle is executed.

While the above examples described a straight line narrowing, curved narrowing lines may be obtained similarly. Local knitting courses and narrowing courses are arranged according to the curve of narrowing lines. When a CAD apparatus is used, the pattern data and stitch size may be numerized, the ratio of length of segment AC to that of segment BC is calculated upon these data, and the numbers of local knitting courses and the narrowing courses are determined. A CAD apparatus may automatically adjust the above numbers so that the resultant fabric is similar to the dress pattern. Thus knitting data for the narrowing may be easily obtained.

It is claimed:

1. A knitting method for knitting clothing on a flat knitting machine, said method comprising the steps of:

providing a flat knitting machine having at least a front needle bed and at least a rear needle bed;

knitting a first body of knit clothing with said flat knitting machine, said first body having a first number of courses of stitches at shoulder portions thereof;

knitting a second body of the knit clothing with said flat knitting machine, with a second number of courses of stitches at shoulder portions thereof, said first number of courses of stitches being greater than said second number of courses of stitches, wherein said first body has a length which is longer than a length of said second body, said second body being knit with a neck portion disposed adjacent and above shoulder portions thereof; and joining the first body and the second body, wherein the first body extends past a shoulder line of the knit clothing, and wherein a fall is formed in the second body from the shoulder portions to the neck portion.

2. A knitting method as recited in claim 1, wherein the step of knitting the second body includes knitting the shoulder portions and the neck portion thereof simultaneously with the step of joining the first and second bodies.

3. A knitting method as recited in claim 2, wherein said step of knitting the second body comprises the steps of:

knitting a first portion at a side edge of shoulder portions thereof;

knitting a second portion at said side edge, wherein the second portion is wider in stitch range than the first portion;

transferring a plurality of stitches in said first portion inward of the second body; and transferring a stitch from a side edge of the first body to the second body, with a most outside stitch of the first body overlapping one of the plurality of stitches.

4. A knitting method as recited in claim 1, wherein said step of knitting the second body comprises a step of knitting the second body utilizing a flechage knitting process to knit the shoulder and neck portions, and wherein the step of joining the first and second body includes a step of binding-off.

5. A knitting method as recited in claim 1, further comprising the steps of:

knitting the first body to include two first sleeve portions, said first sleeve portions being knit prior to said shoulder portions of the first body;

knitting the second body to include two second sleeve portions, said second sleeve portions being knit prior to said shoulder and neck portions of the second body;

wherein said first body, the first sleeve portions, the second body, and the second sleeve portions are knitted to form a tube at and above the armpits around armholes of the knit clothing, wherein stitches of the first and second sleeve portions are transferred to the first and second bodies such that the transferred stitches of the first and second sleeve portions are overlapped with non-transferred stitches of the first and second bodies, and also comprising a step of transferring stitches of the first and second sleeve portions to the first body such that transferred stitches of the first and second sleeve portions and non-transferred stitches of the first body are overlapped.

6. A knitting method as recited in claim 5, wherein the first body is a front body of the knit clothing, and the second body is a back body of the knit clothing, and wherein the step of forming the first body includes forming a neck hole therein at shoulder portions thereof, and wherein the first body is knit with a number of courses of stitches which exceeds a number of courses which are used to knit the second body.

7. A knitting method on a flat knitting machine, said method comprising the steps of:

providing a flat knitting machine having at least a front needle bed and at least a second needle bed abutting with each other for knitting knit clothing by knitting a first body and a second body and two tubular sleeves;

knitting the two tubular sleeves and the first and the second bodies up to armpits of the clothing, wherein the first and the second bodies are connected at both ends thereof so that the first and the second bodies form a tube;

connecting the first and the second bodies and the two sleeves into another tube, knitting from the armpits and forming armholes of the clothing while knitting said another tube, transferring stitches of the sleeves to the first and the second bodies so that the stitches transferred and stitches of the first and the second bodies are overlapped;

knitting shoulder portions of the first body and transferring stitches of the two sleeves to the first body so that the stitches transferred and stitches of the first body are overlapped;

knitting shoulder portions of the second body; and joining the first and the second bodies at shoulder portions of the clothing.

8. A knitting method as recited in claim 7, wherein said step of knitting said shoulder portions of the second body includes a step of knitting a neck portion adjacent to and above the shoulder portions of the second body.

9. A knitting method for knitting clothing on a flat knitting machine, said method comprising the steps of:

providing a partially knit fabric on the flat knitting machine;

knitting a first following stitch course comprising at least a stitch at a side edge of the knit fabric;

transferring said first following stitch course inside the knit fabric; and knitting a second subsequent stitch course in the side edge of the fabric, said second subsequent stitch course having a wider range than said first following stitch course.

10. A knitting method as recited in claim 9, wherein said first following stitch course comprises a plurality of stitches at the side edge of the knit fabric.

11. A knitting method as recited in claim 10, wherein the knitting steps and the transferring step are repeated with a number of repetitions being dependent upon a shape of the knit fabric.

12. A knitting method as recited in claim 11, wherein said step of knitting a first following stitch course, said step of transferring the first following stitch course, and said step of knitting a subsequent stitch course are regularly repeated.

13. A knitting method as recited in claim 11, wherein a number of repetitions of the knitting steps and transferring step are determined based upon a length of a narrowing line and a size of a stitch of the knit fabric at a position separated from the narrowing line and perpendicular to a knitting width.

14. A knit fabric, said knit fabric produced by a knitting process comprising the steps of:

providing a flat knitting machine having at least a front needle bed and at least a second needle bed abutting with each other for knitting knit clothing by knitting a first body and a second body and two tubular sleeves;

knitting the two tubular sleeves and the first and the second bodies up to armpits of the clothing, wherein the first and the second bodies are connected at both ends thereof so that the first and the second bodies form a tube;

connecting the first and the second bodies and the two sleeves into another tube, knitting from the armpits and forming armholes of the clothing while knitting said another tube, transferring stitches of the sleeves to the first and the second bodies so that the stitches transferred and stitches of the first and the second bodies are overlapped;

knitting shoulder portions of the first body and transferring stitches of the two sleeves to the first body so that the stitches transferred and stitches of the first body are overlapped;

knitting shoulder portions of the second body; and joining the first and the second bodies at shoulder portions of the clothing.

* * * * *